US010590794B2

(12) United States Patent
Sebrecht et al.

(10) Patent No.: US 10,590,794 B2
(45) Date of Patent: Mar. 17, 2020

(54) TURBINE ENGINE COMPRESSOR, IN PARTICULAR OF AN AEROPLANE TURBOPROP OR TURBOFAN

(71) Applicant: Snecma, Paris (FR)

(72) Inventors: Pierre-Alain Francis Claude Sebrecht, Moissy Cramayel (FR); Sébastien Cochon, Moissy Cramayel (FR); Arnaud Langlois, Moissy Cramayel (FR)

(73) Assignee: Safran Aircraft Engines, Paris (FR)

( * ) Notice: Subject to any disclaimer, the term of this patent is extended or adjusted under 35 U.S.C. 154(b) by 573 days.

(21) Appl. No.: 15/103,956

(22) PCT Filed: Dec. 4, 2014

(86) PCT No.: PCT/FR2014/053163
§ 371 (c)(1),
(2) Date: Jun. 13, 2016

(87) PCT Pub. No.: WO2015/092197
PCT Pub. Date: Jun. 25, 2015

(65) Prior Publication Data

US 2016/0348530 A1 Dec. 1, 2016

(30) Foreign Application Priority Data

Dec. 19, 2013 (FR) ..... 13 62972

(51) Int. Cl.
*F01D 17/16* (2006.01)
*F04D 29/56* (2006.01)

(52) U.S. Cl.
CPC ..... *F01D 17/162* (2013.01); *F04D 29/56* (2013.01); *F04D 29/563* (2013.01);
(Continued)

(58) Field of Classification Search
None
See application file for complete search history.

(56) References Cited

U.S. PATENT DOCUMENTS 3,066,488 A * 12/1962 Mock ..... F01D 17/162 415/130
3,314,595 A * 4/1967 Burge ..... F01D 17/162 415/160

(Continued)

FOREIGN PATENT DOCUMENTS

EP 1 672 180 A1 6/2006
EP 1 808 579 A2 7/2007

(Continued)

*Primary Examiner* — Mary E McManmon
*Assistant Examiner* — Richard K. Durden
(74) *Attorney, Agent, or Firm* — Blank Rome LLP

(57) ABSTRACT

A turbine engine compressor includes a stator featuring an annular casing and at least one annular row of variable-pitch vanes, wherein each vane comprises a radially external end having a pivot mounted in an orifice in the casing and connected by a linking member to an control ring capable of pivoting axially in relation to the casing, where the linking member comprises a first end fixed to the pivot of the vane and a second end having a pin inserted in a hole in the control ring, where at least one of the holes in the control ring serves for insertion of the pins of the linking members, is oblong in shape and extends in the circumferential direction in order to allow movement of the pin in the oblong hole, during rotation of the control ring.

2 Claims, 5 Drawing Sheets

(52) U.S. Cl.
CPC ..... *F01D 17/167* (2013.01); *F05D 2220/323* (2013.01); *F05D 2220/3216* (2013.01); *F05D 2240/12* (2013.01); *F05D 2270/58* (2013.01)

(56) References Cited

U.S. PATENT DOCUMENTS

| | | | | | |
|---|---|---|---|---|---|
| 3,861,822 | A * | 1/1975 | Wanger | F01D 17/162 | 415/147 |
| 4,737,071 | A | 4/1988 | Horn, Jr. | | |
| 5,993,152 | A * | 11/1999 | Schilling | F01D 17/162 | 415/155 |
| 7,413,401 | B2 * | 8/2008 | Szucs | F01D 17/162 | 415/160 |
| 7,802,964 | B2 * | 9/2010 | Bouru | F01D 17/20 | 415/149.4 |
| 8,297,918 | B2 * | 10/2012 | Bhatnagar | F04D 29/563 | 415/160 |
| 2011/0176913 | A1 | 7/2011 | Wassynger et al. | | |

FOREIGN PATENT DOCUMENTS

| | | |
|---|---|---|
| EP | 2 204 549 A2 | 7/2010 |
| FR | 1 592 922 A | 5/1970 |

* cited by examiner

TURBINE ENGINE COMPRESSOR, IN PARTICULAR OF AN AEROPLANE TURBOPROP OR TURBOFAN

TECHNICAL FIELD

The present invention relates to a turbine engine compressor, in particular a high-pressure compressor of an aeroplane turboprop or turbofan.

BACKGROUND

In a manner known per se, a turbine engine compressor comprises several compressor stages, each having an annular row of mobile vanes mounted on a rotor shaft and an annular row of variable-pitch stator vanes mounted at their radially external ends on a substantially cylindrical external casing.

Adjustment of the angular setting of the stator vanes in a turbine engine is intended to optimise the output of said turbine engine and reduce its fuel consumption during the different phases of flight.

The variable-pitch stator vanes each comprise at their radially external end a radial pivot, which is centred and rotationally guided in an orifice in the external casing. Each vane pivot is connected by a crank-arm to a control ring that surrounds the external casing of the compressor and is rotationally movable around the longitudinal axis of the compressor by actuating means in order to transmit to the vanes a rotational movement around the axes of their pivots.

Each crank-arm is fixed to the vane pivot and comprises a cylindrical pin inserted in a cylindrical hole in the control ring.

During rotation of the control ring around its axis, the latter causes the crank-arms and the vanes to pivot around the axis of the vane pivot. The total angular range of rotation of the crank-arms is conventionally on the order of 50 to 90°. The ring is also axially movable so as to accompany the path of the pins. All the vanes are in this case situated in the same angular position for a given angular position of the control ring.

Now, depending on the speed of the turbine engine, it is necessary to be able to adapt the pitch of the vanes, particularly as a function of their azimuthal position, i.e. the circumferential position of the stator vane in the corresponding stage. The pitch angles allowing maximisation of the turbine engine output may therefore differ as a function of the azimuthal positions of the stator vanes in a given stage.

Indeed, the gas flow in the stream passing through the high-pressure compressor is not uniform over its entire circumference, wherein said flow may comprise pockets causing losses of performance. Furthermore, when the turbine engine is operating at high speed, high forces and torques are applied to the vanes, which tends to slightly distort the control ring.

SUMMARY

The aim of the invention is in particular to provide a simple, effective and economical solution to this problem, while avoiding any hyperstatism of the system, which requires having crank-arms that are all substantially of the same length.

To this end, it proposes a turbine engine compressor, in particular of an aeroplane turboprop or turbofan, comprising a stator featuring an annular casing and at least one annular row of variable-pitch vanes, wherein each vane comprises a radially external end having a pivot mounted in an orifice in the casing and connected by a linking member to an control ring capable of rotating about an axis of the casing, wherein said linking member comprises a first end fixed to the pivot of the vane and a second end having a pin inserted in a hole in the control ring, serving for insertion of the pins of the linking members, is oblong in shape and extends in the circumferential direction in order to allow movement of the pin in said oblong hole, during rotation of the control ring.

Thus, depending on the shape of the hole, it is possible to adjust the pitch angle of each vane, individually or by groups of vanes, while retaining linking members (crank-arms for example) having the same length. This adjustment allows adaptation to the heterogeneity of the gas flow and correction of any deformations at high engine speed.

The oblong hole extending in the circumferential direction does not necessary extend solely in the latter direction, i.e. along a radial plane perpendicular to the axis of the control ring. Indeed, the oblong hole may extend both in the axial direction and in the circumferential direction.

According to one characteristic of the invention, the pins are cylindrical.

Furthermore, at least one of the holes in the control ring, serving for insertion of the pins of the linking members, may be shaped so as to inhibit movement of the pin in said hole.

In this case, the control ring may comprise at least one cylindrical hole in which a cylindrical pin of a linking member is inserted, wherein the diameters of the pin and of the cylindrical hole are substantially identical, in addition to one oblong hole extending circumferentially in which another cylindrical pin of another linking member is inserted.

According to a first embodiment of the invention, said oblong hole in the control ring comprises a first end located on the side of a first lateral edge of the control ring and a second end located on the side of a second lateral edge of the control ring, wherein both ends are connected by a curved joining area featuring an inflection point.

According to a second embodiment of the invention, said oblong hole in the control ring extends solely in the circumferential direction.

According to a third embodiment of the invention, said oblong hole in the control ring extends obliquely in relation to the axial direction and in relation to the circumferential direction.

According to a fourth embodiment of the invention, said oblong hole in the control ring forms an arc shape.

According to a fifth embodiment of the invention, said oblong hole in the control ring comprises a first end extending solely circumferentially and located on the side of a first lateral edge of the control ring and a second end extending solely circumferentially located on the side of the other lateral edge of the control ring, wherein said ends are connected by a joining area extending obliquely in relation to the circumferential direction and in relation to the axial direction.

The invention furthermore relates to a turbine engine, such as for example an aeroplane turboprop or a turbofan, comprising at least one compressor of the aforementioned type.

BRIEF DESCRIPTION OF THE DRAWINGS

The invention will be better understood and other details, characteristics and advantages thereof will become apparent in reading the following description, given by way of a non-restrictive example with reference to the appended drawings in which.

DETAILED DESCRIPTION

Figure 1:
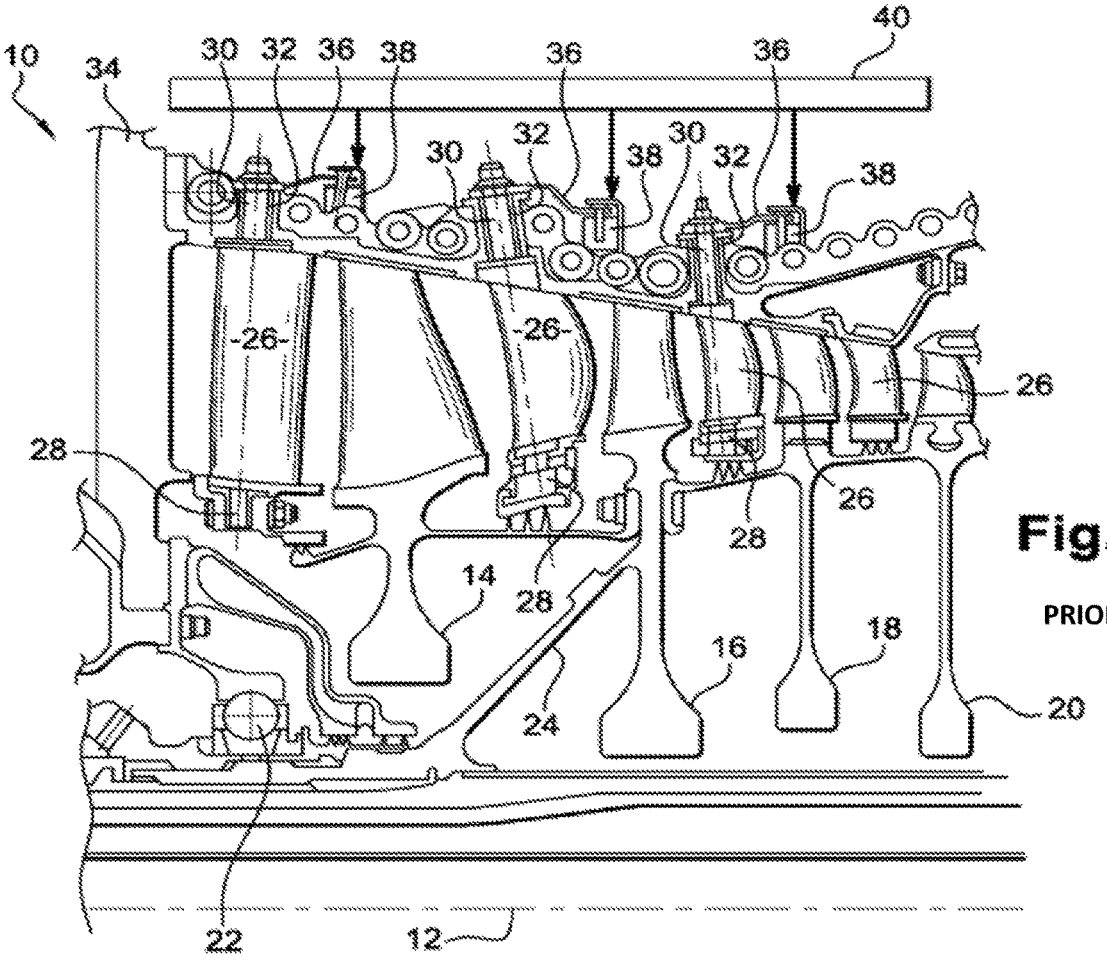
Fig. 1 PRIOR ART
FIG. 1 is a partial, cross-sectional axial diagrammatic half-view of a high-pressure compressor of a turbofan equipped with a variable-pitch vane control system according to the prior art.

Reference will be made initially to FIG. 1, which represents a diagrammatic half-view of the upstream portion of a high-pressure compressor 10 according to the prior art, in cross-section along a plane passing through the axis of rotation 12 of the turbine engine. The high-pressure compressor 10 comprises a rotor formed of discs 14, 16, 18, 20 axially assembled with one another, wherein the rotor abuts against a bearing 22 by means of a trunnion 24.

Each disc is arranged downstream from an annular row of variable-pitch stator vanes 26. Each stator vane comprises coaxial cylindrical pivots 28, 30 at its radially internal and external ends. The internal cylindrical pivot 28 extends inwards from the stator vane 26 and is centred and rotationally guided in a cylindrical recess of an annular element of the stator and the external cylindrical pivot 30 extends radially outwards and is centred and rotationally guided in a cylindrical shaft 32 of a substantially cylindrical external casing 34 of the high-pressure compressor 10.

Adjustment of the pitch angle of the stator vanes 26 of a stage is performed by means of crank-arms 36, which are rotated by a control ring 38 pivotably mounted in relation to the casing 34 around the axis 12. The total displacement of the control ring is for example included between 5 and 20°. A hydraulic actuator 40 allows simultaneous rotational movement of several control rings 38. The ring 38 is, for example, formed of two parts 39 assembled with one another by means of saddles (not illustrated) fixed to the ends of said parts 39.

Figure 2:
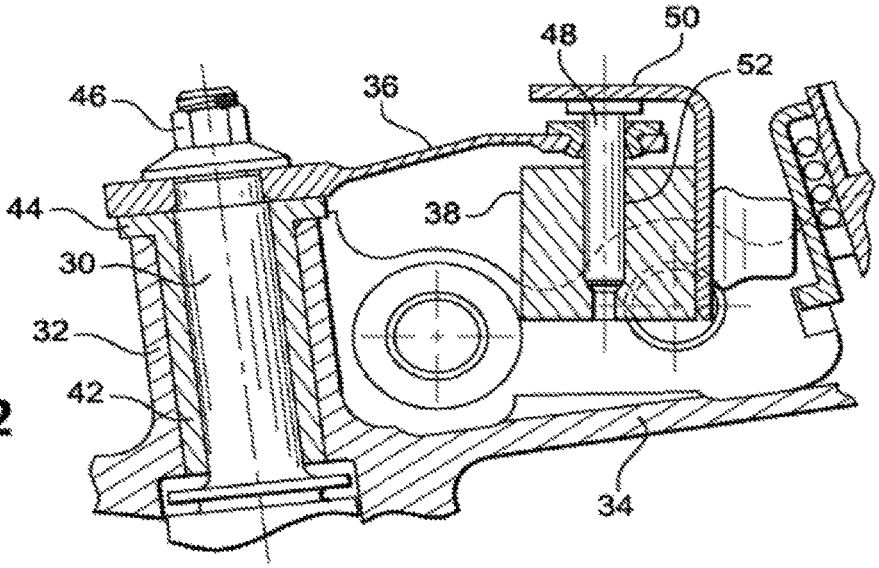
Fig. 2 PRIOR ART
FIG. 2 is a larger-scale cross-sectional axial diagrammatic view of the pitch angle system of a stage of the compressor in FIG. 1.
Figure 4:
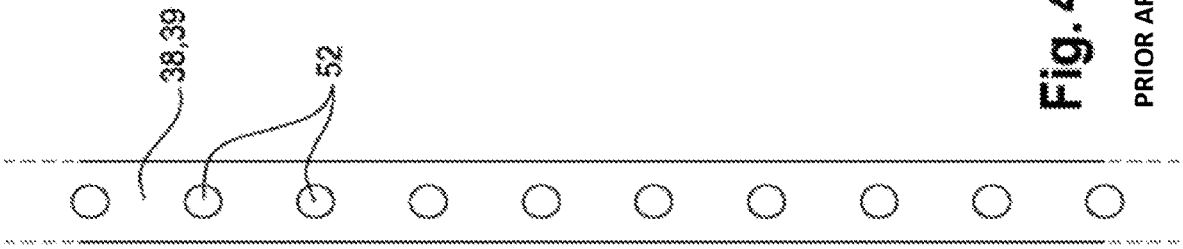
Fig. 4 PRIOR ART
FIG. 4 is a diagrammatic view, from above, of an area of the control ring illustrated in FIG. 3, FIGS. 5 and 6 are views corresponding respectively to FIGS. 3 and 4, illustrating a first embodiment of the invention.

The crank-arms 36 are fixed at one end to the radial pivots 30 of the variable-pitch vanes 26, wherein said pivots 30 are rotationally guided in bushings 42 installed in the shafts 32 of the casing 34 (FIG. 2). The end of the crank-arm fixed to the vane pivot 30 is retained radially on an edge 44 of the bushing 42 by a nut 46 screwed on to the end of the pivot 30. The other end of the crank-arm 36 comprises an orifice in which a radial cylindrical pin 48 is rotationally guided, installed in a cylindrical hole 52 in the control ring 38. The pins 48 are held in position by bent tabs 50 fixed to the control ring 38. The control ring 38 is also axially movable in translation so as to accompany the circular path of the pins 48.

Figure 3:
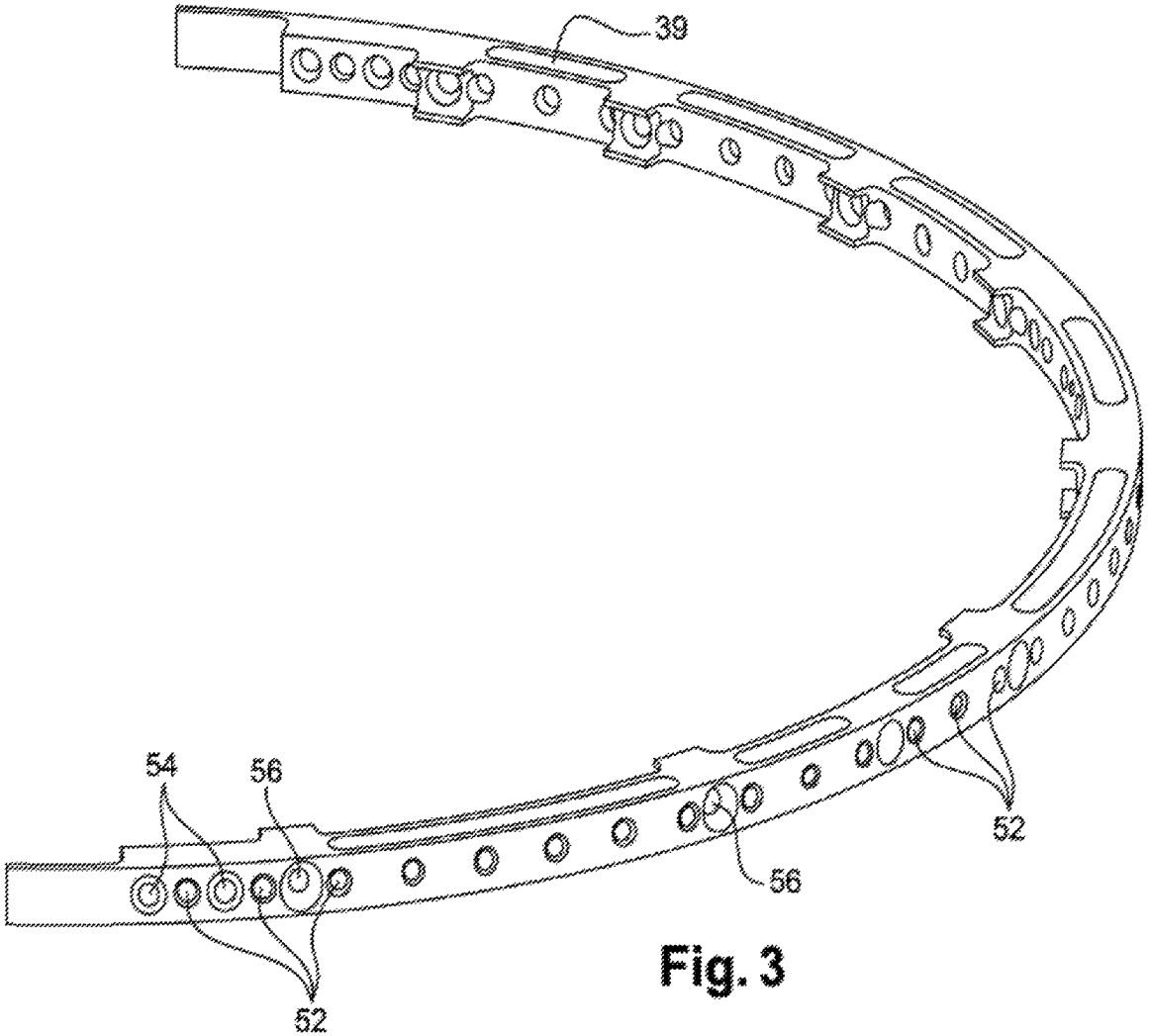
Fig. 3 PRIOR ART
FIG. 3 is a perspective view of a part of a control ring.

As can be seen more clearly in FIG. 3, the parts 39 of the control ring 38 comprise other holes 54, 56 serving respectively for fixing linking members allowing mutual connection of the ends of both parts 39 of the linking member 38 or serving for fixing centring pads applied to a track arranged on the external surface of the casing.

During rotation of the control ring 38 around its axis 12, the latter causes the crank-arms 36 and the vanes 26 to pivot around the axis of the pivots 28, 30 of the vanes 26. All the vanes 26 are in this case situated in the same angular position for a given angular position of the control ring 38, wherein the crank-arms 36 are all of the same length.

Now, as stated above, depending on the speed of the turbine engine, it is necessary to be able to adapt the pitch of the vanes 26, particularly as a function of their azimuthal position, i.e. the circumferential position of the stator vane 26 in the corresponding stage.

The invention fulfills this requirement by proposing a control ring 38 allowing adjustment of the pitch angle of the vanes 26, individually or by group of vanes 26, depending on the azimuthal positions of the vanes 26 in question or the groups of vanes 26 in question.

Figure 6:
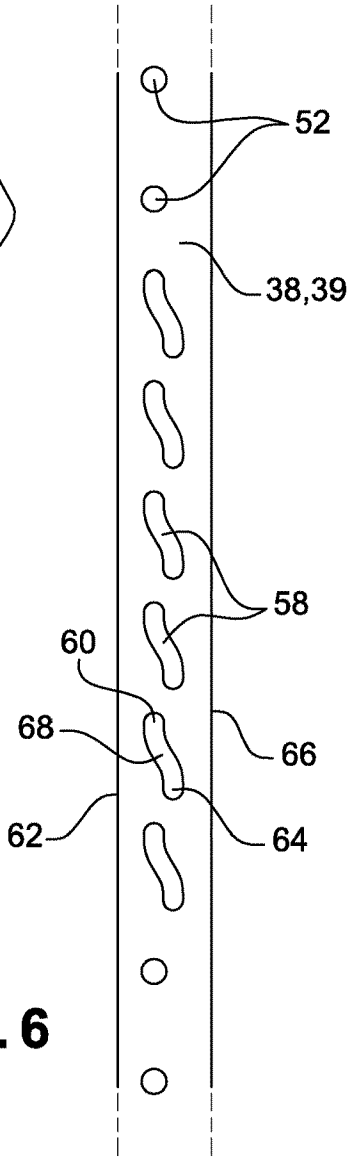
Figure 5:
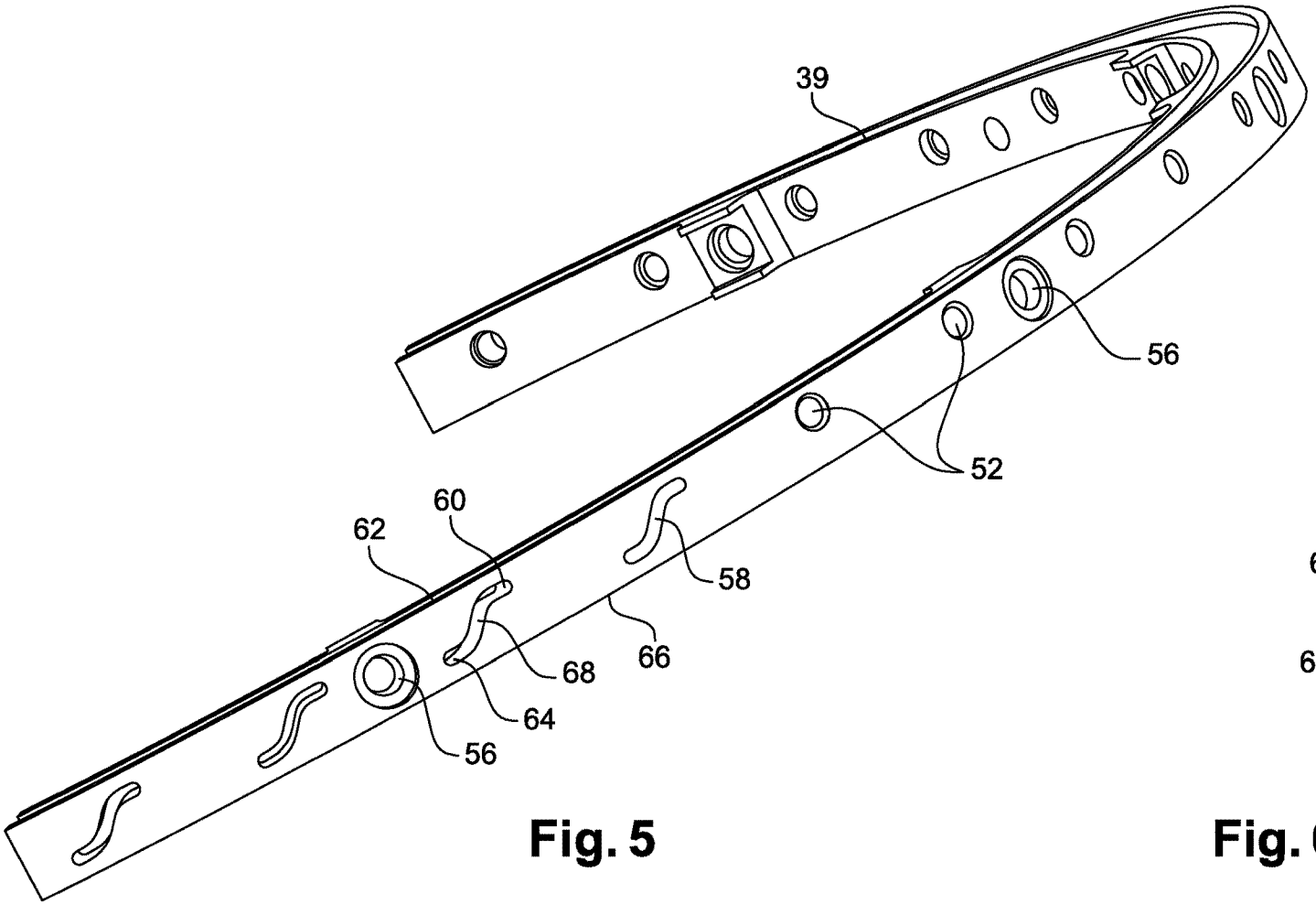

FIGS. 5 and 6 illustrate a first embodiment of the invention in which one set of the holes in which the cylindrical pins 48 are inserted are oblong in shape (holes 58) and another set of said holes are cylindrical (holes 52) with a diameter substantially identical to that of the corresponding pins 48.

In particular, the oblong holes 58 each comprise a first end 60 located on the side of a first lateral edge or upstream edge 62 of the control ring 38 and a second end 64 located on the side of a second lateral edge or downstream edge 66 of the control ring 38, wherein both ends 60, 64 are connected by a curved joining area 68 featuring an inflection point.

Hence, during operation, the pitch angle of the vanes 26 does not vary in the same way, depending on the angular position of the control ring 38, for the vanes 26 associated with the cylindrical holes 52 or for the vanes 26 associated with the oblong holes 58. Depending on the shape of the holes 58, the variation in the pitch angle can therefore be adjusted as a function of the angular position of the control ring 38 (also known hereafter as pitch law) for each of the vanes 26.

In this case, all the oblong holes 58 are of substantially the same shape, with the other holes 52 being cylindrical. A control ring 38 of this type therefore features two groups of vanes 26, located in different azimuthal areas of the turbine engine, obeying different pitch laws from one group to another.

It will be noted that the centre of the holes 52 is aligned circumferentially with one of the ends of the oblong holes 58.

Figures 7, 8, 9:
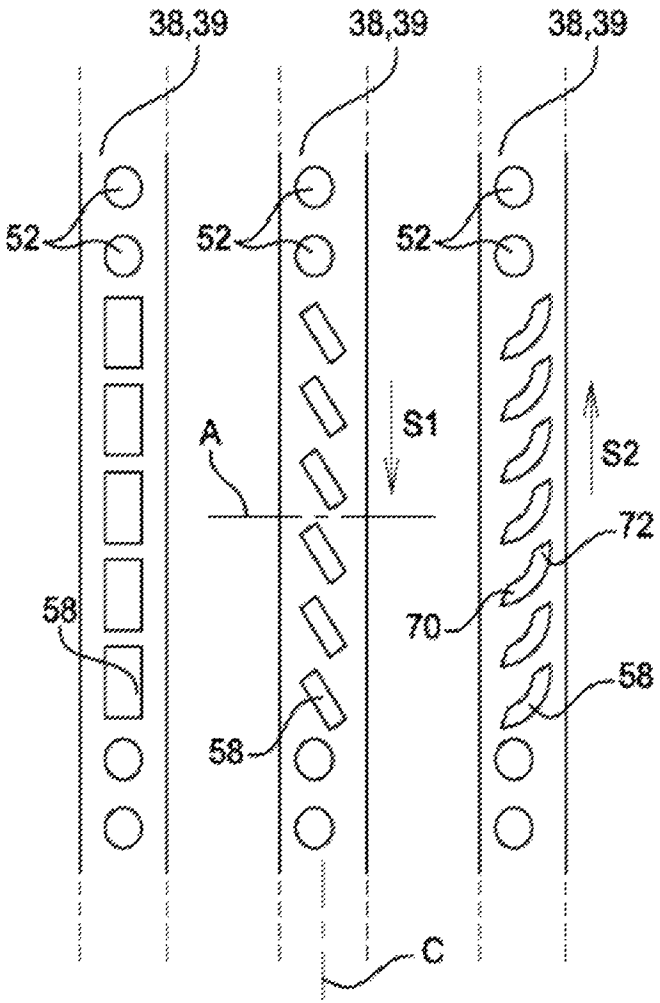
FIG. 7 is a view corresponding to FIG. 4, illustrating a second embodiment of the invention.
FIG. 8 is a view corresponding to FIG. 4, illustrating a third embodiment of the invention.
FIG. 9 is a view corresponding to FIG. 4, illustrating a fourth embodiment of the invention.

FIG. 7 illustrates a second embodiment of the invention in which each oblong hole 58 of the control ring 38 extends solely in the circumferential direction.

FIG. 8 shows a third embodiment of the invention in which each oblong hole 58 in the control ring 38 extends obliquely in relation to the axial direction A and in relation to the circumferential direction C. More specifically, each oblong hole 58 extends linearly, from upstream to downstream (i.e. from left to right in FIG. 8), in a first direction of rotation of the control ring denoted by the arrow S1, which is a direction of opening of the vanes 26.

FIG. 9 shows a fourth embodiment of the invention in which each oblong hole 58 in the control ring 38 forms an arc shape or an approximate arc shape, more specifically a quarter circle. One end 70 of each oblong hole 58 is oriented axially upstream, whereas the other end 72 is oriented circumferentially in a direction S2 opposite the aforementioned direction S1, wherein the direction S2 is the direction of closing of the vanes 26.

Figure 10:
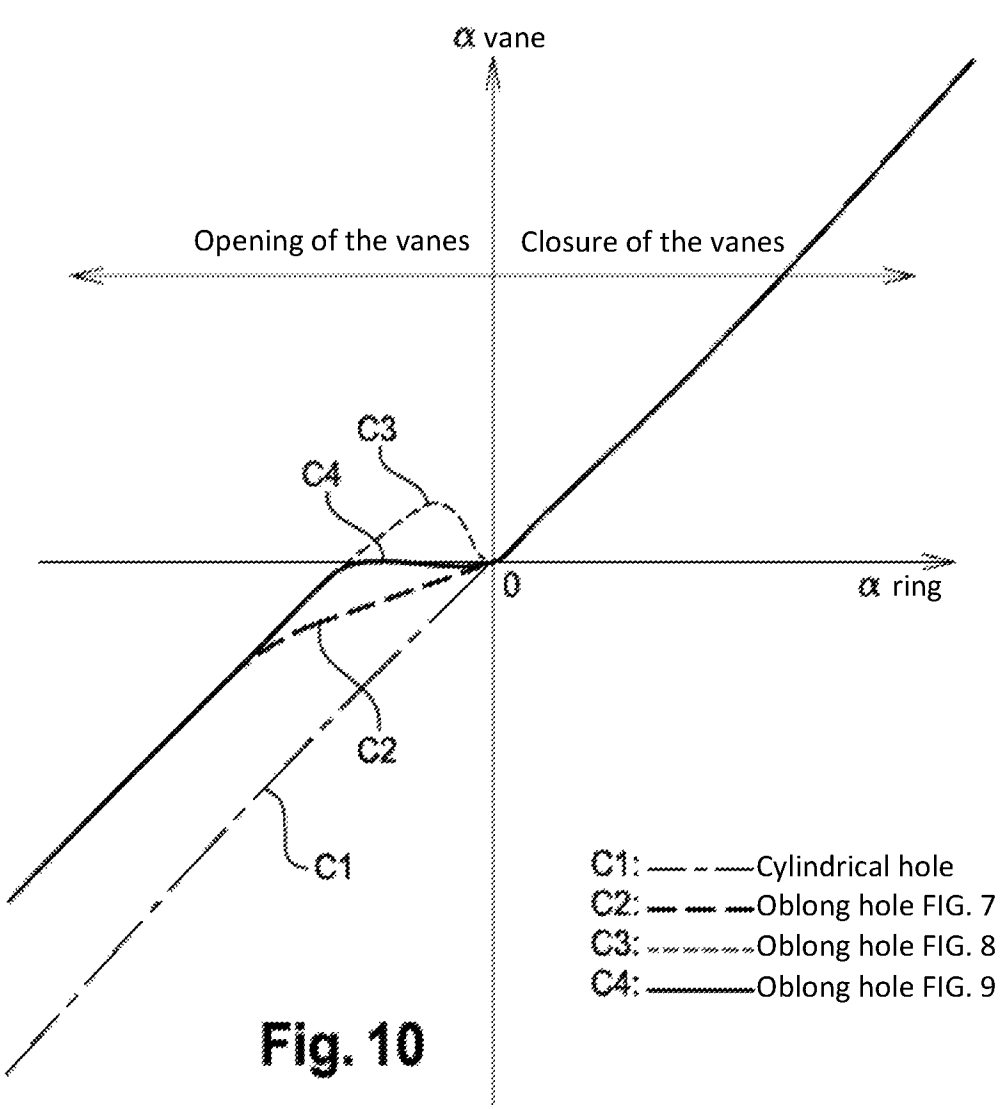
FIG. 10 is a diagram showing the change in the pitch angle of the stator vanes as a function of the angular position of the control ring, for each of the embodiments in FIGS. 7, 8 and 9.

FIG. 10 illustrates the vane pitch law for vanes 26 associated respectively with a cylindrical hole 52 (curve C1), with an oblong hole 58 in FIG. 7 (curve C2), with an oblong hole 58 in FIG. 8 (curve C3) and with an oblong hole 58 in FIG. 9 (curve C4). The pitch laws are the curves reflecting the change in the angular position of the vane 26 ($\alpha$vane) as a function of the angular position of the control ring 38 ($\alpha$control ring).

It will be noticed that these pitch laws are different from one another, particularly in the case of the angles of the control ring 38 corresponding to an opening of the associated vanes 26. The angle $\alpha$vane corresponds to the angle of the crank-arms 36 in relation to the axis 12 of the turbine engine, plotting a straight line passing through the centre of the pivot 30 of the vane 26 and the centre of the pin 48 which is inserted in the ring 38. By definition, the open position corresponds to an angle $\alpha$vane that is negative in relation to the axis 12 of the turbine engine, considering that the positive direction is the trigonometric direction and the closed position corresponds to an angle $\alpha$vane that is positive in relation to the axis 12 of the turbine engine. The angle $\alpha$vane=0 corresponds to the position in which the crank-arms 36 are aligned with the axis 12 of the turbine engine.

If one seeks to change the pitch laws for the angles corresponding to closure of the vanes 26, oblong holes 58 may be used, the general shapes of which are the symmetrical forms/axis of the turbine engine of those described above. In this case however, the centre of the holes 52 should be aligned with the other end of the oblong holes 58.

Depending on the selected shape of the hole 52, 58 (cylindrical, oblique straight, arc shape, etc. . . . ) it is thus possible to adapt the pitch law of the associated vanes 26 to suit needs.

Figure 11:
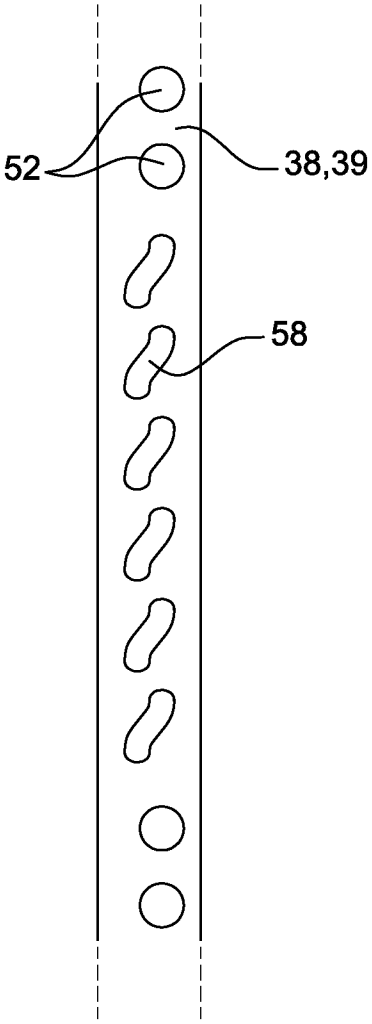
FIG. 11 is a view corresponding to FIG. 4, illustrating a fifth embodiment of the invention.

FIG. 11 illustrates a fifth embodiment of the invention in which each oblong hole 58 of the control ring 38 is of a shape symmetrical to that of the oblong holes 58 in FIG. 6, in relation to a radial plane passing through the axially median area of the control ring 38.

Figure 12:
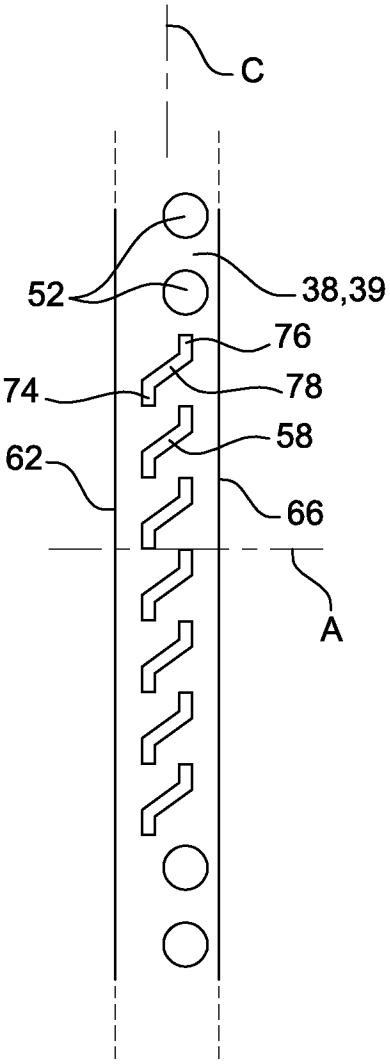
FIG. 12 is a view corresponding to FIG. 4, illustrating a sixth embodiment of the invention.

FIG. 12 illustrates a sixth embodiment of the invention, wherein each oblong hole 58 in the control ring 38 comprises a first end 74 extending solely circumferentially and located on the side of the upstream edge 62 of the control ring and a second end 76 extending solely circumferentially located on the side of the downstream edge 66 of the control ring 38, wherein said ends 74, 76 are connected by a joining area 78 extending obliquely in relation to the circumferential direction C and in relation to the axial direction A.

Figure 13:
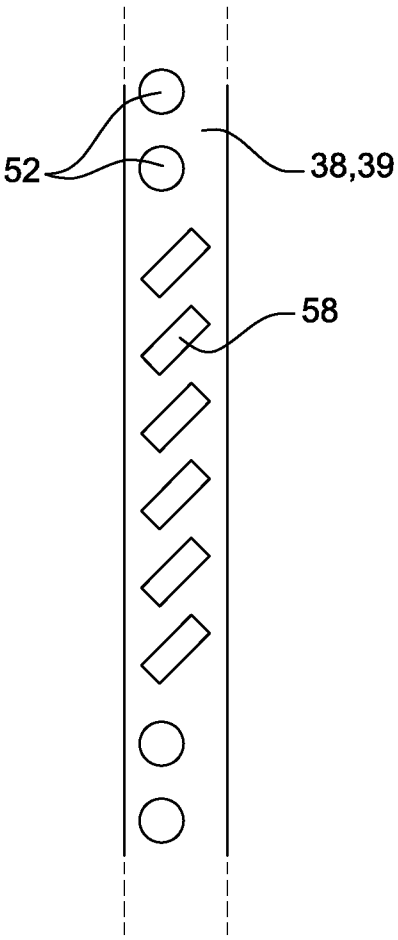
FIG. 13 is a view corresponding to FIG. 4, illustrating a seventh embodiment of the invention.

FIG. 13 illustrates a seventh embodiment of the invention in which each oblong hole 58 of the control ring 38 is of a shape symmetrical to that of the oblong holes 58 in FIG. 8, in relation to a radial plane passing through the axially median area of the control ring 38.

Naturally, the control ring 38 may comprise at least two types of oblong hole 58 among those described above. Other forms of oblong hole 58 may also be used, provided that these oblong holes 58 extend particularly in the circumferential direction C.

The invention claimed is:

1. A turbine engine compressor comprising a stator featuring an annular casing and at least one annular row of variable-pitch vanes including:

a first vane comprising a first radially external end having a first pivot mounted in a first orifice in the casing and connected by a first linking member to a control ring capable of rotating about an axis of the casing, wherein said first linking member comprises a first end fixed to the first pivot of the first vane and a second end having a first cylindrical pin inserted in a first hole in the control ring; and a second vane comprising a second radially external end having a second pivot mounted in a second orifice in the casing and connected by a second linking member to the control ring, wherein said second linking member comprises a third end fixed to the second pivot of the second vane and a fourth end having a second cylindrical pin inserted in a second hole in the control ring, wherein the first hole comprises a circular hole, wherein the second hole comprises an oblong hole in order to allow movement of said second cylindrical pin in said oblong hole during rotation of the control ring, wherein said oblong hole in the control ring comprises a first end located on the side of a first lateral edge of the control ring and a second end located on the side of a second lateral edge of the control ring, and wherein both ends are connected by a curved joining area featuring an inflection point.

2. A turbine engine comprising at least one turbine engine compressor according to claim 1.

* * * * *